United States Patent [19]

Cosme

[11] Patent Number: 5,011,242

[45] Date of Patent: Apr. 30, 1991

[54] DRAWER GUIDE ASSEMBLY

[76] Inventor: Peter A. Cosme, R.R. 7-Box 319, Lockport, Ill. 60441

[21] Appl. No.: 10,545

[22] Filed: Feb. 3, 1987

[51] Int. Cl.[5] ..... A47B 88/00

[52] U.S. Cl. ..... 312/344.1; 312/342; 384/23

[58] Field of Search ..... 312/330 R, 341 NR, 336, 312/337, 342, 345, 246, 344.1, 382; 384/22, 23

[56] References Cited

U.S. PATENT DOCUMENTS

| | | | |
|---|---|---|---|
| 2,341,093 | 2/1944 | Heberstump | 312/342 X |
| 3,647,271 | 3/1972 | Allred | 312/342 X |
| 3,694,049 | 9/1972 | Gutner | 312/342 X |
| 3,702,717 | 11/1972 | Gutner | 384/23 |
| 3,850,482 | 11/1974 | Gutner | 384/22 |
| 3,926,492 | 12/1975 | Gutner | 384/23 X |
| 4,389,079 | 6/1983 | Cosme | 384/23 X |
| 4,501,453 | 2/1985 | Gutner et al. | 384/23 |
| 4,534,600 | 8/1985 | Cosme | 384/23 |

*Primary Examiner*—Joseph Falk
*Attorney, Agent, or Firm*—Browdy and Neimark

[57] ABSTRACT

A prefabricated metal drawer-slide assembly for mounting in a cavity of a furniture unit, comprising a female channel-shaped guide member terminating in ends on a common level, the member adapted to be mounted in the cavity and to extend between front and back side of the furniture unit, for guiding a complementary male component affixed to a bottom side of a slideable drawer adapted for reciprocally movement in the cavity. The assembly further comprises an elevated reinforcing rib extending along the major length of a bottom side of the female guide member between the ends, and downwardly sloping terminal portions extending from opposite ends of the elevated rib for mergence with the opposite ends. Each of the terminal portions are inclined slightly to the horizontal and are provided with a screw opening adapted to accommodate an attachment screw for affixing the female guide member to frame elements of the furniture unit on a common level, the screws adapted to extend at a slight angle to the vertical and sufficient to clear a driving tool of the screw from the frame elements of the furniture unit irrespective of any vertical spacing between the frame elements. Protuberance are provided on the reinforcing rib which co-act with a minimal frictional resistance place member to provide a limited stop in the course of withdrawal of the drawer.

16 Claims, 5 Drawing Sheets

DRAWER GUIDE ASSEMBLY

BACKGROUND OF THE INVENTION

The present invention relates to a drawer guide assembly functioning as a center guide for a drawer reciprocably movable in openings or cavities of furniture cases of all types. The instant invention seeks to improve upon the drawer slide assemblies disclosed in my earlier U.S. Pat. Nos. 4,389,079, Jun. 21, 1983, and 4,534,600, Aug. 13, 1985.

SUMMARY OF THE INVENTION

The present invention relates to a low-cost rugged slide assembly comprised essentially of a pair of interfitting channel-shaped members of stamped sheet metal functioning as a center guide for a drawer reciprocally movable within an opening or cavity of furniture cases of all types, such as chests, desks, dressers, tables or the like. The invention is particularly useful in furniture units with drawers of low depth because the screw-mountings of the ends of the female channel member within the cavity are angled, so that the furniture frame presents no hindrance to the driving tools from the screws, to attain an extremely strong fastening of the fixed female channel member so that it is capable of withstanding rough handling, not only in the course of fabrication and transportation but also in the course of its use. In addition, a uniform and consistent stop action against the unintentional withdrawal of the drawer from the cavity is attained by relying on the cooperation between the yieldable legs on the base of a synthetic plastic guide block mounted on the end of the male channel member and rounded projections on the lateral walls of the central reinforcing rib extending upwardly along the female channel member, which is traversed by the guide block. The invention also makes possible the ready conversion of the basic two-slide assembly to a "premium" assembly affording improved smooth sliding characteristics by the optional detachable insertion of a molded synthetic plastic guide block into the forepart of the female channel to provide low-friction horizontal and vertical bearing surfaces for the to-and-fro movements of the male channel member and the drawer fastened thereto with minimal side-sway and binding. The last-mentioned guide block is snapped into deformations in the lateral walls of the channel which serve to reinforce the latter while functioning as yieldable retaining means. The lateral walls of the channel members of the assembly are devoid of incisions or apertures in order to impart maximum strength to the assembly.

It is the object of the present invention to simplify the mountings and ruggedness of the channel members constituting the elements of the assembly, while improving the smooth operation thereof over long periods of time. The invention is particularly useful in cases having drawers of low depth by making possible the driving of the fastening screws for the female channel member without hindrance of the close superposition of the rails of the furniture case.

It is also an object of the invention to improve the provision of the stop of the drawer against unintentional withdrawal by shifting the reliance therefor from projections, notches or cuts in the sheet metal channels to a protuberance on the reenforcing rib of the female channel which coacts with the molded plastic guide mounted on the end of the drawer movable within the female channel. Therefore, a uniform stop action of long life is attained despite variations in the physical properties of the metal slides, occasioned by differences in temper characteristics, dimensional variations and the like.

The invention provides optional conversion capabilities of the sliding assembly from one of lower cost to a "premium" slide by the selective provision of a molded plastic guide block of low friction characteristics which may be readily snapped into place at the front of the female channel to provide a smooth and noiseless support at the front of the assembly for the to-and-fro movements of the male channel member. The ready detachment of the auxiliary guide block does not affect the operation of the slide assembly as one of lower cost.

The improved drawer guide assembly utilizes deformations in the walls thereof to enhance the rigidity of the parts, and is devoid of any incisions or apertures, which result in a stronger and more rugged unit.

BRIEF DESCRIPTION OF THE DRAWINGS

Other objects and purposes will appear from the following detailed description of the invention taken in conjunction with the accompanying drawings, wherein.

DETAILED DESCRIPTION OF THE PREFERRED EMBODIMENTS

Figure 1:
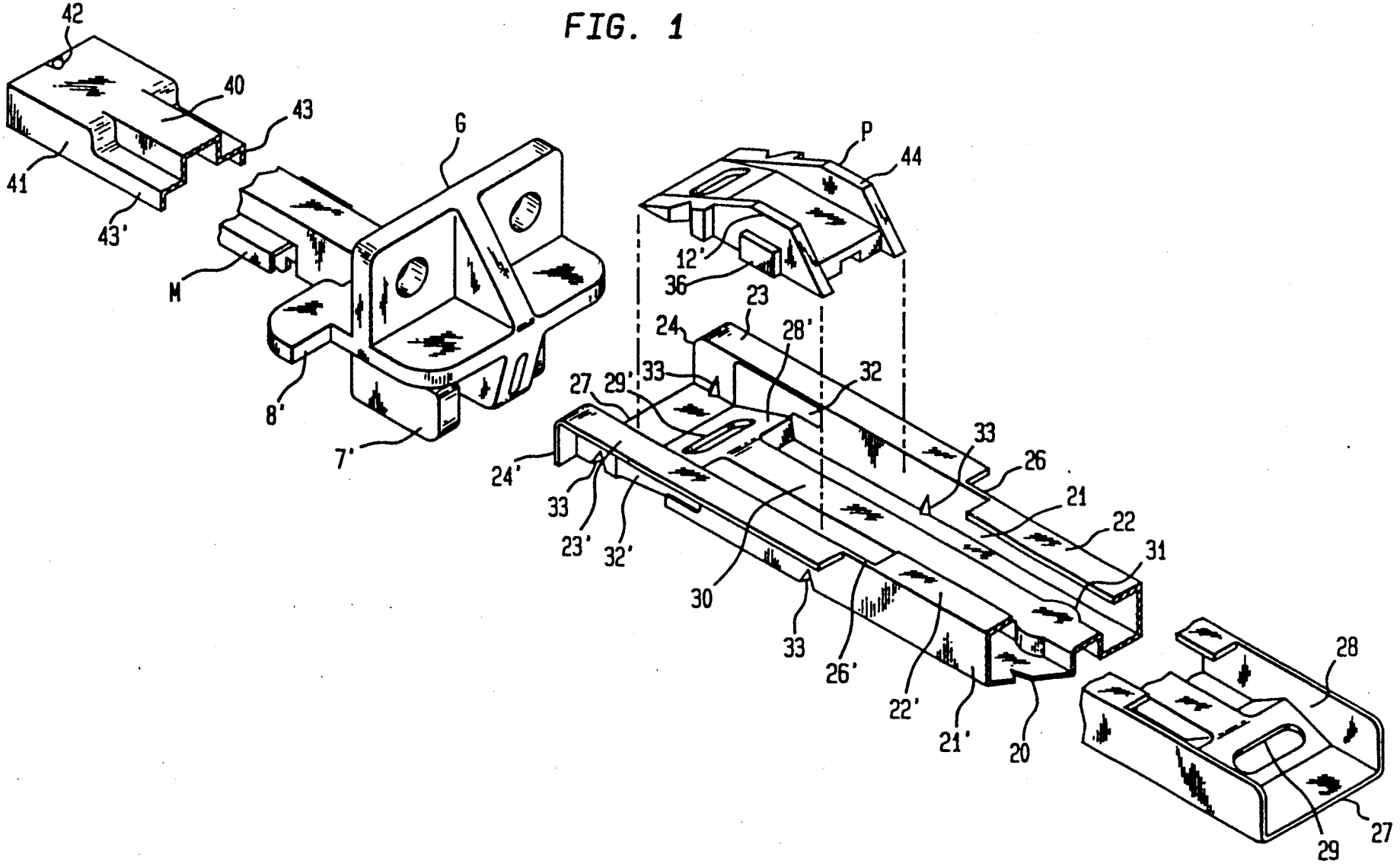
FIG. 1 is a perspective exploded view of the component parts of the assembly illustrating the improved features of the invention.
Figure 3:
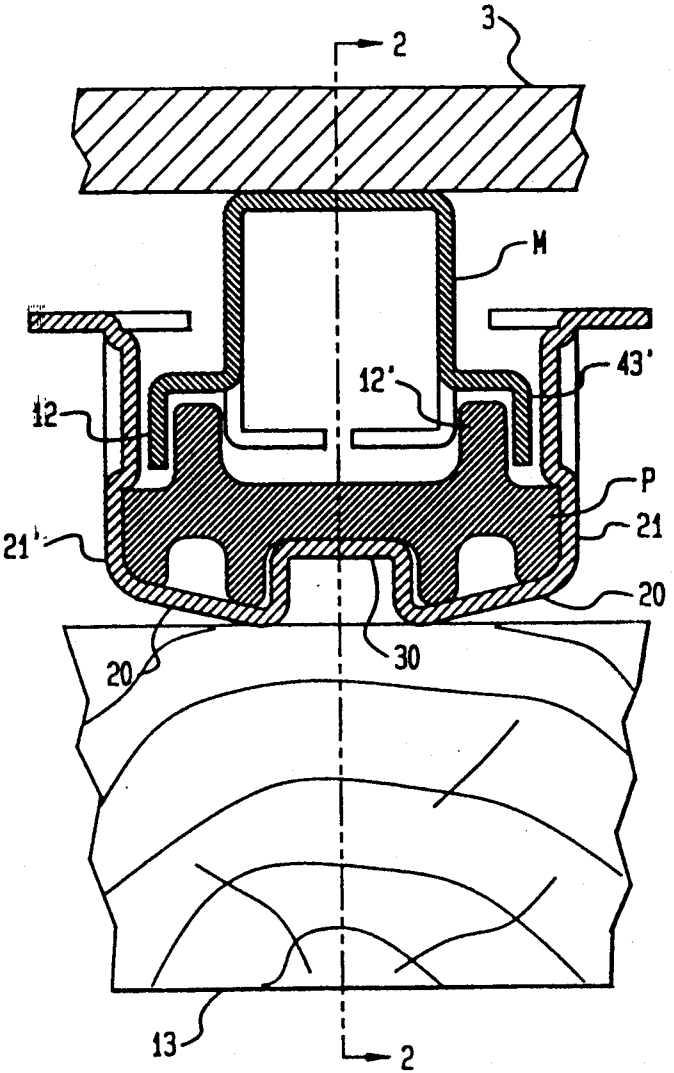
FIG. 3 is a sectional view along line 3—3 of FIG. 2.
Figure 2:
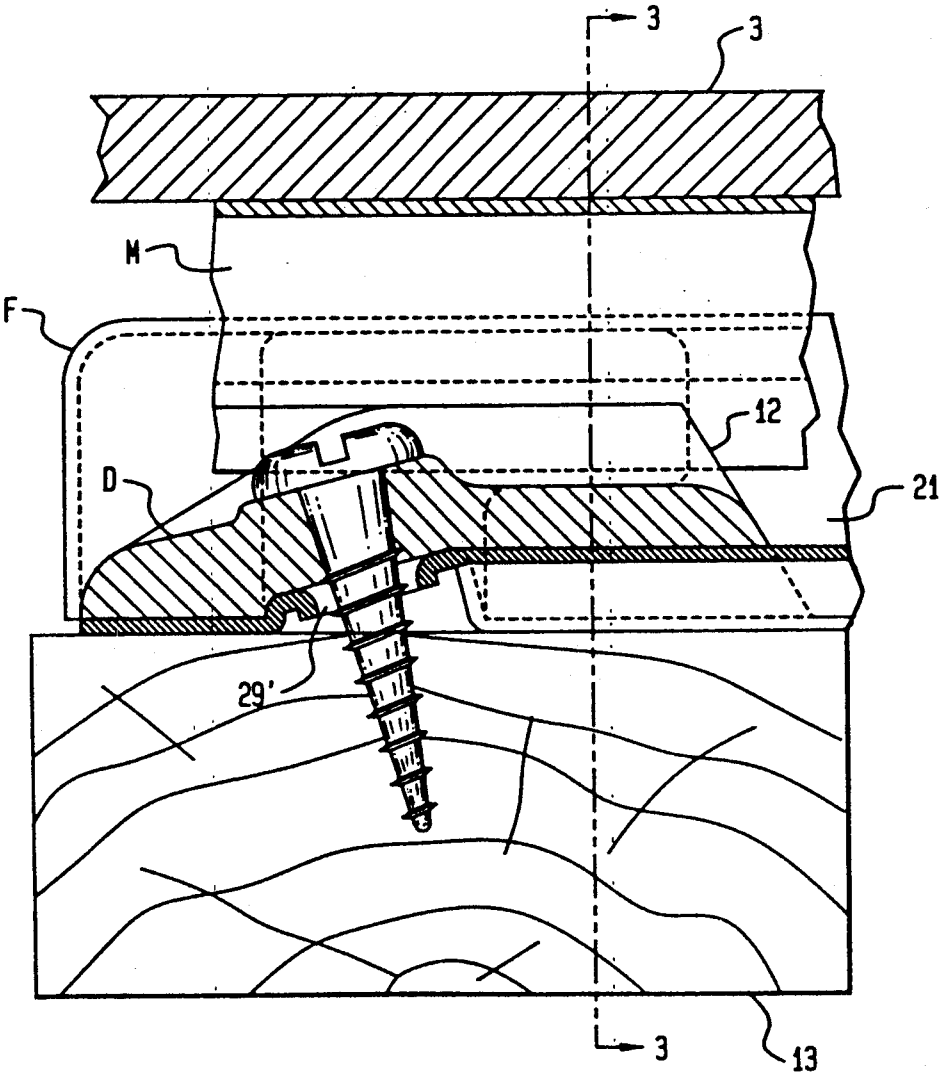
FIG. 2 is a longitudinal sectional view of the front portion of the assembly with the detachable guide block in place.
Figure 5:
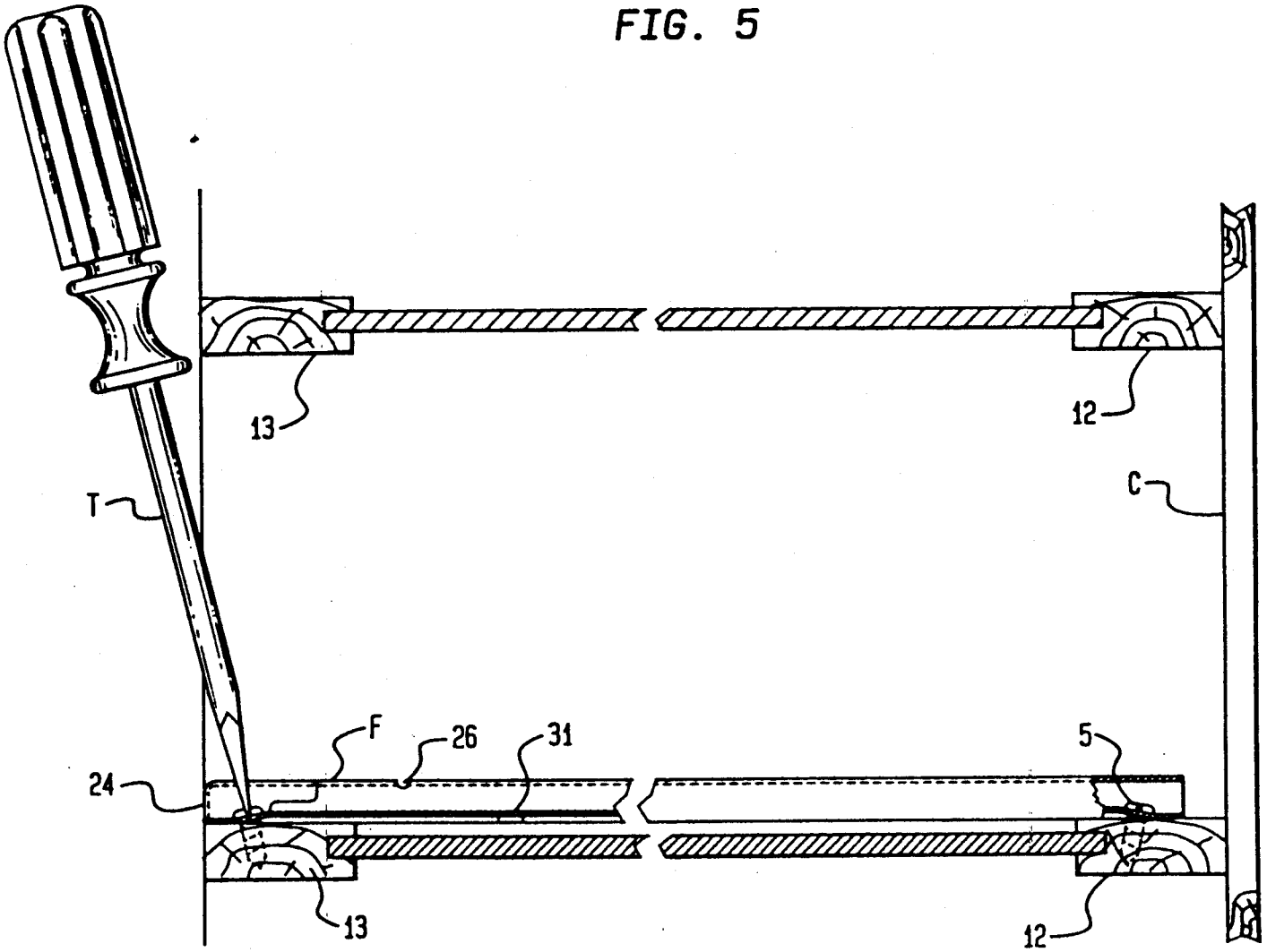
FIG. 5 is a vertical sectional view of a furniture case illustrating the improved angled fastening therein of the female channel member.

As shown in FIG. 1, the female slide F resembles that shown in applicant's above-mentioned U.S. Pat. No. 4,534,600, and consists essentially of a channel formed by a bottom web 20 having a reenforcing rib 30 extending upwardly along the mid-portion thereof for substantially the length of the channel member which terminates in ends 27,27' disposed in a common plane, which are designed to be fixedly mounted on the back and front rails 12 and 13 of the case C, respectively. The female channel member F must extend a minimum of one inch beyond the back of the drawer guide since otherwise interference would be encountered in the mounting of the fastening screw at that point. The setting for the fastenings of the mounting screws for the female channel F constitutes one of the most important features of the improved center guide assembly. The provision of sloping terminal portions 28,28' in the web of the female channel member makes possible the driving of the mounting screws both at its front and rear ends without regard to the distance between the superposed rails of the case. These inclined terminal portions 28,28' extending from the top of the reenforcing rib 30 to the planar positions 27,27' at the ends of the web, which may be approximately 15° to the horizontal, make possible the disposition of the driving tool, whether it be a manual screw driver or a power tool, so that no interference is encountered by the furniture rails 12 and 13 thereabove. This is clearly illustrated in FIG. 5.

The screw openings 29,29' in these angled portions 28,28' are preferably elongated in order to permit limited adjustment of the positioning of the channel member within the case, which feature is well known in the art.

While the drawings show angled mountings of the fastening screws S to the opposite rails of a wooden case, this feature could be applied as well to a metal case with the use of self-tapping screws at slightly inclined terminal portions. The inclination of the screws in opposed directions results in an exceptionally strong fastening of the channel to the case.

Figure 4B:
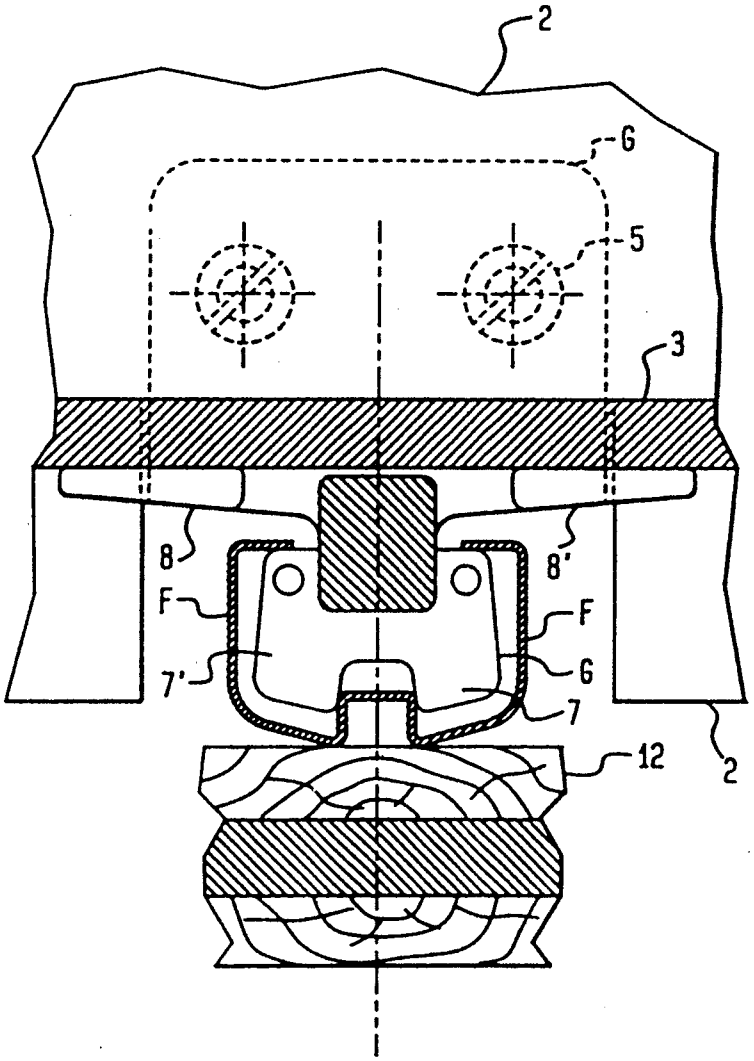
FIG. 4B is a corresponding view showing the same parts as shown in FIG. 4A when the guide block encounters the protuberance in the reenforcing rib, giving rise to the spreading of the legs of the guide block and the resultant improved stop action.
Figure 4A:
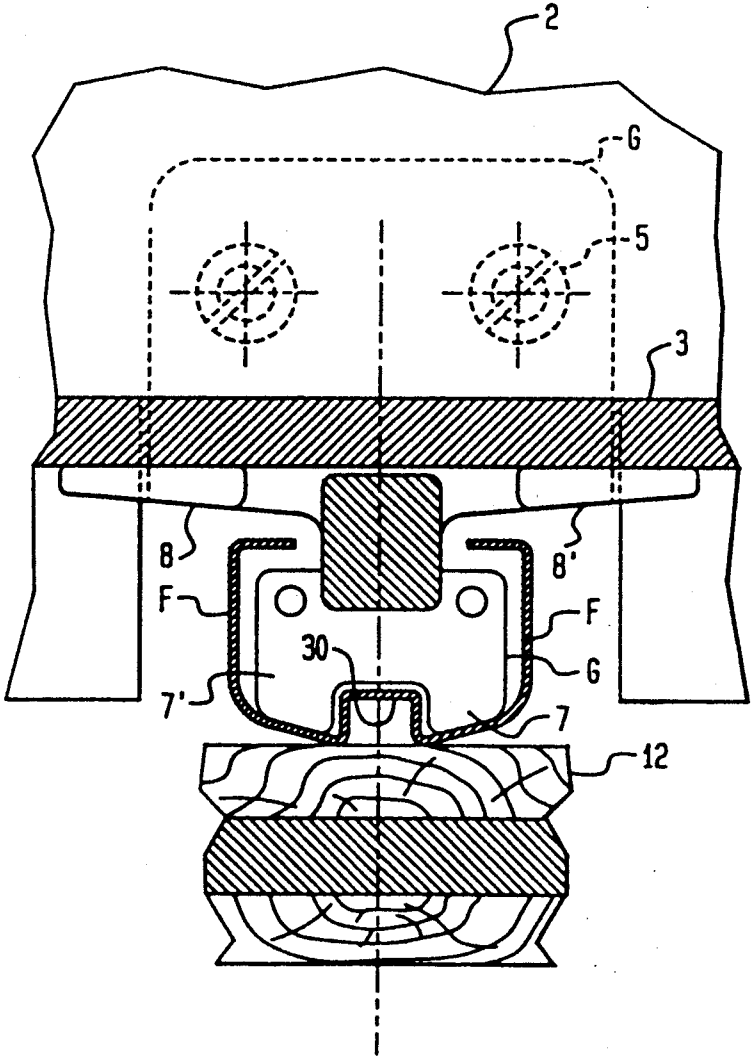
FIG. 4A is a rearward vertical sectional view of the nested channel members showing the base of the guide block G at the end of the male member cooperating with the elevated reenforcing rib of the female member along the major length thereof.

Lateral walls 21,21' extend upwardly from the outer edges of the web 20 for the entire length thereof. Inwardly facing flanges 22,22' are bent from the tops of said walls except at the front of the channel whereat flanges 23,23' are bent outwardly, with continuations 24,24' therefrom in a vertical plane, which function as stops for the drawer D. Gaps 26,26' between the inwardly and outwardly extending flanges permit the introduction of the guide block G affixed to the rear end of the drawer to enter the female channel for reciprocating movement therein. This is a characteristic of my earlier design in U.S. Pat. No. 4,534,600. In the present construction, the projections 7,7' at the base of the guide block G which straddle the reenforcing rib 30, soon encounter the rounded protuberances 31 on the rib which serves to spread the projections and cause a binding thereof as the male channel is advanced towards the rear of the case. This resistance is readily overcome so that the drawer is capable of to-and-fro movement without binding as is clearly shown in FIG. 4A. However, the protuberances offer sufficient resistance to the unintentional withdrawal movement of the drawer during reverse movement and serve as a uniform and reliable stop against further withdrawal movement of the drawer, unless this impediment is overcome by the exertion of further force.

Another important structural feature of the invention resides in the ready conversion capability of the assembly to a "premium" unit. This is attained by snapping the auxiliary molded plastic guide block P of low frictional charateristics into the forepart of the female channel member as indicated by its superposition in FIG. 1.

Deformations 32 and 32' are formed in the lateral walls 21,21' of the channel which receive lateral projections 36 on the sides of the block which are accommodated in said deformations. In addition, spaced deformations 33 at the junctions of the web and lower walls serve to confine the molded guide block at the forepart of the channel member.

The male channel member M is provided with a central rib 40 which overlies the elevated rib 30 and is fitted with downwardly extending angled extremities 43,43' which fit within and are adapted to slide within the female channel member F. The auxiliary guide block P provides tracks 44,44' for the angled extensions 43,43' of the male channel member. The movable parts of the assembly fit closely and there is minimal side sway to the drawer in the course of its to-and-fro movements.

The front end of the male channel member is provided with a hooded portion 41 and the front part of which has an opening 42 for receiving a fastening screw S for fixing the front end of the male channel M to the front 1 and bottom 3 of the drawer D. The elimination of incisions in the male channel member at this point adds to the strength of this member and constitutes a substantial improvement over that disclosed in applicant's earlier patent.

Figure 6:
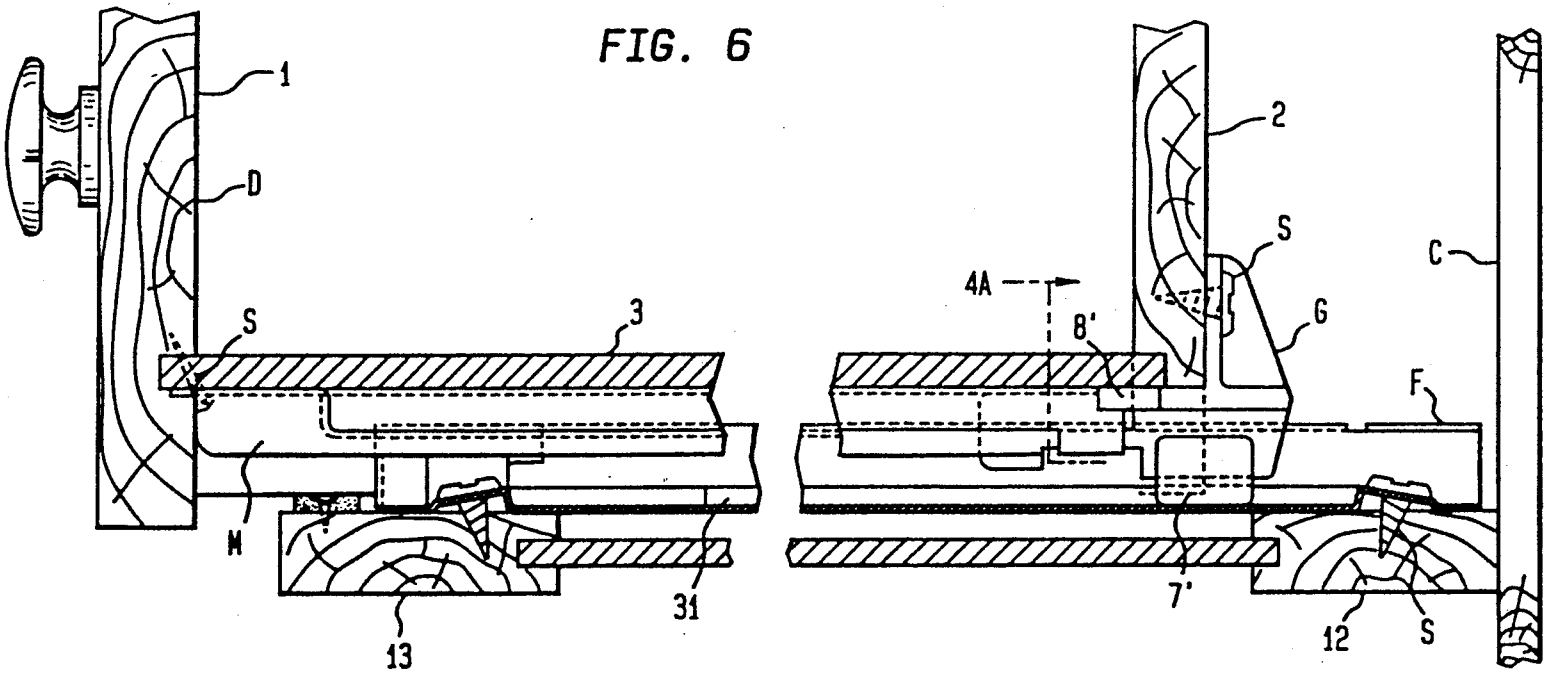
FIG. 6 is a vertical sectional view of the guide assembly with the drawer and male channel member slideable within the female channel member.
Figure 7:
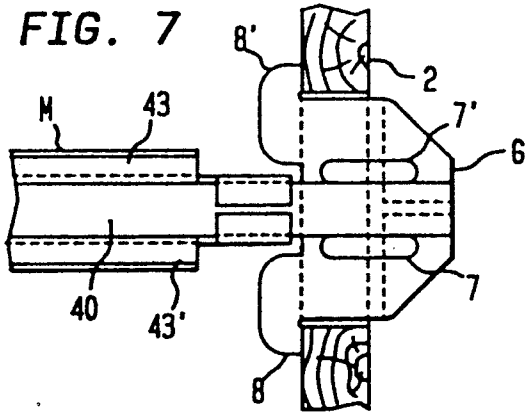
FIG. 7 is a bottom view along of FIG. 6 to illustrate an improved mounting of the guide block at the end of the slideable drawer.

The male channel member is also strengthened in the instant invention by modifying the design of guide block G to include lateral lugs 8 and 8' at the intermediate portion of the base of the block in contact with the front face of the back 2 of the drawer, as shown in FIGS. 1, 6 and 7 to complement the fastening of the vertical wall of the guide block G to the outer wall 2 of the drawer. The slip connection between the rearward end of the male channel and guide block G permits adjustment of the positioning of the rear wall of the guide block which is fastened to the outer wall of the drawer to take care of drawer size variations. This feature is disclosed in my earlier U.S. Pat. No. 4,534,600.

All of the features described above combine to strengthen measurably the two components of the slide assembly without adding substantially to the cost thereof. Furthermore, the smoothness and quietness of operation of the slide assembly are improved tremendously.

I claim:

1. A prefabricated metal drawer-slide assembly for mounting in a cavity of a furniture unit, comprising:

(a) a female channel-shaped guide member terminating in ends on a common level, said member adapted to be mounted in said cavity and to extend between front and back sides of the furniture unit, for guiding a complementary male component affixed to a bottom side of a slideable drawer adapted for reciprocally movement in said cavity, (b) an elevated reinforcing rib extending along the major length of a bottom side of said female guide member between said ends, (c) downwardly sloping terminal portions extending from opposite ends of said elevated rib for mergence with said opposite ends, each of said terminal portions being inclined slightly to the horizontal and provided with a screw opening adapted to accommodate an attachment screw for affixing said female guide member to frame elements of said furniture unit on a common level, said screws adapted to extend at a slight angle to the vertical and sufficient to clear a driving tool of the screw from the frame elements of the furniture unit irrespective of any vertical spacing between the frame elements.

2. The combination set forth in claim 1, wherein the inclination of each of the sloping terminal portions is approximately 15° to the horizontal.

3. A device as set forth in claim 1, wherein said screw openings in said terminal portions are elongated transversely to a longitudinal axis of said female member and are directed downwardly in opposite directions.

4. The combination set forth in claim 1, including a detachable guide block of synthetic plastic material adapted to be snapped into a front end of said channel-shaped guide member, said block having a rearward portion thereof overlying a front end of said elevated reinforcing rib of said guide member with lateral portions extending downwardly thereof into reinforcing deformations in each lateral wall of said female guide member and upwardly extending shoulders for providing track supports of low frictional characteristics for the male component of the slide assembly, and an inclined portion adjacent said front end for seating closely onto the inclined terminal portion at the front end of said female guide member.

5. An assembly as set forth in claim 4, wherein said inclined portion is provided with an opening overlying said screw opening in said channel-shaped guide member for receiving the inclined attachment screw for fixing the front end of said guide member to the cavity of the furniture unit.

6. An assembly as set forth in claim 4, wherein said guide block is provided with projections in external lateral walls adjacent to bottom edges thereof for confinement within said deformations, and additional spaced notches at the bottom of said channel-shaped guide member at the ends of said guide block for reenforcing the security of said confinement.

7. A drawer slide assembly for a cabinet having a cavity and a drawer slideably seated within said cavity, comprising:

(a) a first channel member comprised of a bottom web having a reinforcing elevated rib at a central portion of the bottom web and lateral walls at opposite edges of the bottom web extending upwardly therefrom, said lateral walls terminating in inwardly facing flanges having front ends thereof terminating a short distance from a front of the cavity, said member adapted to be fixedly mounted to said cabinet within said cavity, (b) a second channel member adapted to be affixed to a bottom of said drawer for nesting and sliding movement within said first channel member, (c) a body of material having minimal frictional resistance and comprising a vertical member adapted to be affixed to a rear wall of the drawer, and an integral base portion extending below the bottom of the drawer of a cross-sectional contour conforming substantially to the cross-section of said first channel member and comprising a pair of spaced projections extending downwardly in straddling relation to said elevated rib with a limited capability of lateral yieldability during longitudinal travel through said first channel member functioning as a closely fitting track therefor; and (d) impeding means extending outwardly from said reinforcing elevated rib slightly beyond and forwardly of said front ends of said inwardly facing flanges, adapted to permit forward passage of said body into an interior of said first channel member by causing said spaced projections to spread apart, while preventing unintentional withdrawal of the drawer by providing a limited stop thereto in the course of forward movement of the drawer.

8. The combination set forth in claim 7, including inclined terminal portions adjacent to extremities of said first channel member, said extremities being disposed in a same plane as the bottom of said web with said terminal portions sloping from opposite ends of said elevated reenforcing rib to said extremities of said channel member, and said terminal portions each having an opening therein for receiving a fastening screw with a longitudinal axis thereof at a slight angle to the vertical.

9. The combination set forth in claim 8, wherein the lateral walls of said first channel member are formed with outwardly facing flanges at a front end of said first channel member, reinforcing deformations in said lateral walls below said outwardly facing flanges, and an auxiliary guide block of synthetic plastic material adapted to be detachably retained within said deformations for providing smooth guide tracks at an upper portion thereof for movement of the second channel member therealong.

10. The combination set forth in claim 9, wherein a bottom surface of said auxiliary guide block is formed with a smooth horizontal surface at its outer end, a channel-shaped surface at its inner end adapted to superpose an outer end of said bottom web and elevated rib, and an inclined intermediate surface between said bottom and said channel-shaped surfaces with a screw opening therein overlying the screw opening in a terminal portion adjacent to an outer end of said first channel member.

11. The combination set forth in claim 10, including retaining lugs projecting from lateral walls of said auxiliary guide block at least in the range of said inner end thereof.

12. The combination forth in claim 8, wherein lateral walls of said first channel member are formed with outwardly facing flanges at the front end of said member with continuations thereof from a horizontal plane to a vertical plane at the front end of said first channel member.

13. The combination set forth in claim 9, wherein the outwardly facing flanges are extended from a horizontal plane to a vertical plane at a front portion of said first channel member.

14. The combination set forth in claim 7, wherein a front end of said second channel member is formed with a hood-shaped terminal portion with a top and lateral walls thereof continuous with the top and sides of said second channel member overlying a top and sides of said elevated reinforcing rib of said first channel member.

15. The combination set forth in claim 14, having a screw opening at a top of the hood-shaped terminal portion for fastening a front end of the second channel member to a front and bottom portion of the drawer to complement the fastening of the vertical member of said body of material to a rear wall of the drawer.

16. The combination set forth in claim 15, wherein said body of material fastened to the rear wall of the drawer is formed of plastic.

* * * * *